United States Patent [19]

Tsutsumi

[11] 4,441,416

[45] Apr. 10, 1984

[54] PRESSURE FIXING DEVICE

[75] Inventor: Teruo Tsutsumi, Tama, Japan

[73] Assignee: Tokyo Shibaura Denki Kabushiki Kaisha, Kawasaki, Japan

[21] Appl. No.: 417,999

[22] Filed: Sep. 14, 1982

[30] Foreign Application Priority Data

| | | | |
|---|---|---|---|
| Sep. 19, 1981 | [JP] | Japan | 56-147016 |
| Dec. 11, 1981 | [JP] | Japan | 56-198659 |
| May 11, 1982 | [JP] | Japan | 57-77510 |

[51] Int. Cl.[3] ..... B30B 3/02

[52] U.S. Cl. ..... 100/171; 100/160; 72/248; 355/3 FU

[58] Field of Search ..... 100/161, 157, 168, 172, 100/158 R, 171, 47, 160; 68/257; 355/3 FU; 72/248; 219/216, 388; 432/60

[56] References Cited

U.S. PATENT DOCUMENTS

| | | | |
|---|---|---|---|
| 204,701 | 6/1878 | Baldwin | 100/171 |
| 758,003 | 4/1904 | Ely et al. | 72/248 |
| 1,774,155 | 8/1930 | Platou | 72/248 X |
| 2,525,687 | 10/1950 | Kritscher | 72/248 X |
| 3,055,242 | 9/1962 | Wilson | 72/248 X |
| 3,452,181 | 6/1969 | Stryjewski | 355/3 FU |
| 3,786,742 | 1/1974 | Hertrich | 100/171 X |
| 4,343,234 | 8/1982 | Sasaki | 100/158 R |

FOREIGN PATENT DOCUMENTS

| | | | |
|---|---|---|---|
| 1109726 | 9/1955 | France | 100/157 |

*Primary Examiner*—Philip R. Coe
*Assistant Examiner*—Frankie L. Stinson
*Attorney, Agent, or Firm*—Cushman, Darby & Cushman

[57] ABSTRACT

A pressure fixing device for a recording medium comprises a pair of frames, a first roll rotatably supported by the frames, two pair of guide members attached individually to the frames to be movable at right angles to the axis of the first roll, second and third rolls disposed along the first roll so that both ends of the rolls are supported individually by the guide members for rotation, the recording medium being passed between the first and second rolls, and a mechanism for urging the second roll toward the first roll. The mechanism including a pair of compression coil springs extending along the axes of the rolls to apply an urging force in its extending direction, a pair of pressure levers rockable around an axis normal to the axes of the rolls and the moving direction of the guide members, the pressure levers receiving the urging force of the coil springs to urge the second roll toward the first roll. The urging force of the compression coil springs is controlled to adjust the pressure between the first and second rolls through the pressure lever and third roll.

8 Claims, 9 Drawing Figures

PRESSURE FIXING DEVICE

BACKGROUND OF THE INVENTION

This invention relates to a pressure fixing device in which a recording sheet bearing thereon an image formed of toner is passed between a pair of pressure rolls so that the toner is crushed for fixation.

As shown in FIGS. 1 and 2, a prior art pressure fixing device of this type comprises a lower housing 12 fixed on a base 11, and a swingable upper housing 16 one end of which is pivotally connected to one end of the lower housing 12 by means of a pin 15. A lower roll 14 is rotatably supported on the lower housing 12 by means of bearings 13 fixed thereto, while an upper roll 18 is supported on the upper housing 16 by means of bearings 17 fixed thereto. The basal part of a bolt 19 is fixed to the other end of the lower housing 12. The bolt 19 penetrates a hole at the other end of the upper housing 16 so that the tip end of the bolt 19 extends upward from the upper housing 16. A nut 21 is screwed on the upper end portion of the bolt 19, and a compression coil spring 20 is interposed between the nut 21 and the upper housing 16 so as to surround the bolt 19. The spring 20, the bolt 19, and the nut 21 constitute a pressure mechanism. The lower and upper rolls 14 and 17 can be pressed against each other through the medium of the spring 20 and the housings 12 and 16 under a necessary pressure for fixation as the nut 21 is tightened.

The prior art pressure fixing device of the aforementioned construction generally requires high inter-roll pressure and hence, the use of rolls with a large diameter. Accordingly, the gross weight of the fixing device is substantial, and the pressure mechanism must be projected from the upper housing, extending at right angles to the course of recording paper. Thus, the pressure mechanism directly adds to the external dimensions of the fixing device, resulting in an increase in setting space for the fixing device which may be incorporated in a facsimile system or copying apparatus.

In consideration of these circumstances, there is conventionally proposed a pressure fixing device with a construction as shown in FIGS. 3 and 4. This device has a pair of frames 32 which are fixed by prism members 31, spaced apart and facing each other. Each frame 32 is provided with a bearing 33 fixed thereto, and bearings 37 and 38 supported by two guide members 35 and 36, respectively, which can move vertically. An upper roll 34 is rotatably supported by the fixed bearings 33, while intermediate and lower rolls 39 and 40 are rotatably supported by the intermediate and lower movable bearings 37 and 38, respectively. The tip end of a pressure bolt 41 is located under the lower guide member 36 so as to face the same. The bolt 41 is screwed into its corresponding frame 32 from the underside thereof so that it can be adjusted from under the frame 32. A Belleville spring 42 is interposed between the guide member 36 and the tip end of the bolt 41. Pushed up by the bolt 41, the Belleville spring 42 urges the guide member 36 upward. Thus, the lower roll 40 supported by the bearings 38 is urged upward by the guide members 36 to press the intermediate roll 39 against the upper roll 34 with a given force.

Using three rolls with small diameters, the pressure fixing device shown in FIGS. 3 and 4 can enjoy relatively compact, lightweight design. The pressure between the rolls is produced and adjusted by pushing the Belleville springs 42 from under the frames 32 by means of their corresponding pressure bolts 41 screwed in the frames 32 to adjust the flexure of the springs 42. Since the Belleville spring 42 has a spring constant much greater than that of the compression coil spring 20 used in the first example, it is difficult and requires skill to set the pressure to a given level. Since the pressure bolts 41 for pressure adjustment must be handled from under the frames 32, it is guide difficult, if not impossible, to adjust the pressure where the fixing device is incorporated in a facsimile system or copying apparatus.

In the prior art pressure fixing devices of the aforementioned types, the rolls are heavily pressed against one another in a stop or no-load operation mode. Therefore, the working life of the rolls, as well as that of the bearings which are continually subjected to high pressure, is relatively short. Since the rolls are pressed against one another under high pressure, the recording paper to be fixed cannot be easily and smoothly inserted between the rolls, possibly causing a jam. When the recording paper leaves the rolls, moreover, the rolls will clash with each other to produce a noise.

SUMMARY OF THE INVENTION

The object of this invention is to provide a pressure fixing device capable of compact and lightweight design, facilitating adjustment of pressure between rolls, and ensuring improved life performance of the rolls and bearings without requiring maintenance or inspection for a long time.

BRIEF DESCRIPTION OF THE DRAWINGS

FIGS. 1 and 2 show a prior art pressure fixing device, in which FIG. 1 is a partially broken front view, and FIG. 2 is a side view;

FIGS. 3 and 4 show a prior art pressure fixing device of another type, in which FIG. 3 is a partially broken front view, and FIG. 4 is a side view;

FIGS. 5 and 6 show a pressure fixing device according to an embodiment of this invention, in which FIG. 5 is a partially broken front view, and FIG. 6 is a sectional view taken along line 6—6 of FIG. 5;

DETAILED DESCRIPTION OF THE PREFERRED EMBODIMENT

There will now be described a pressure fixing device according to an embodiment of this invention with reference to the accompanying drawings.

Figure 2:
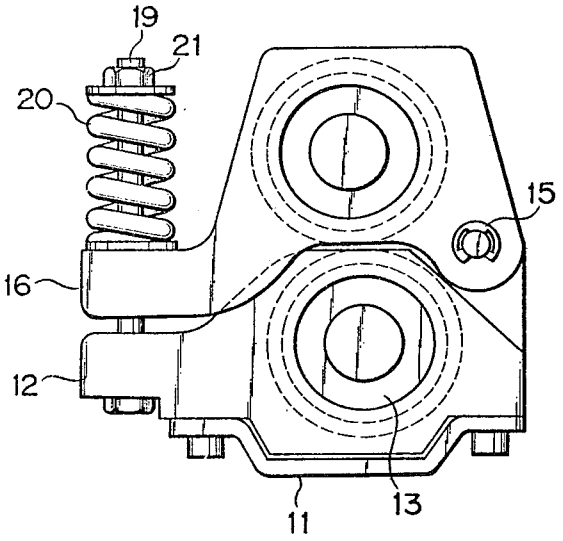
FIG. 2 (PRIOR ART)
Figure 1:
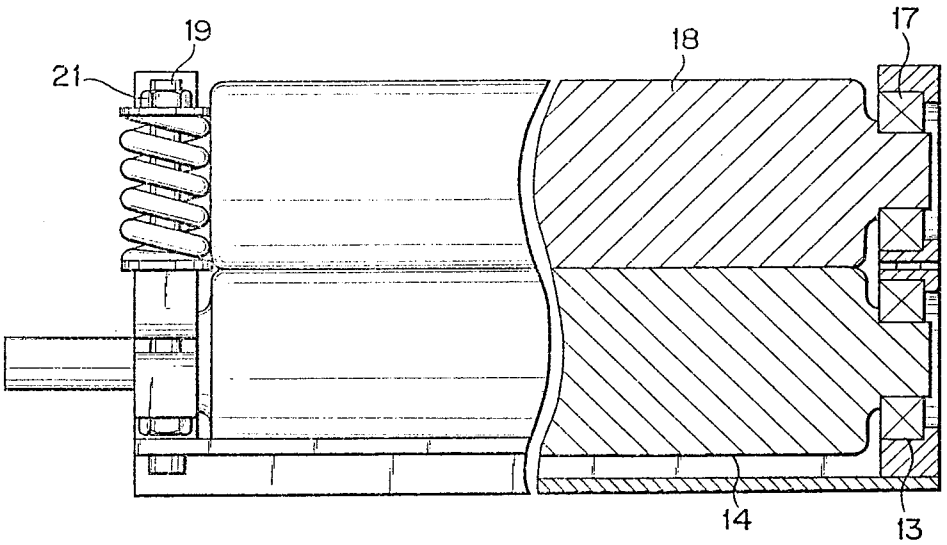
FIG. 1 (PRIOR ART)
Figure 4:
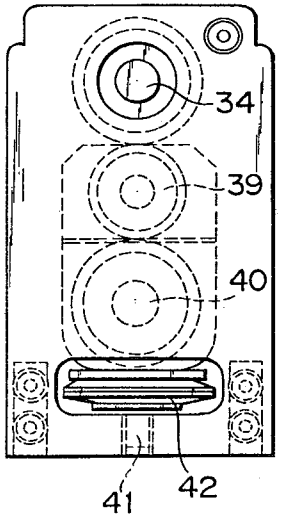
FIG. 4 (PRIOR ART)
Figure 3:
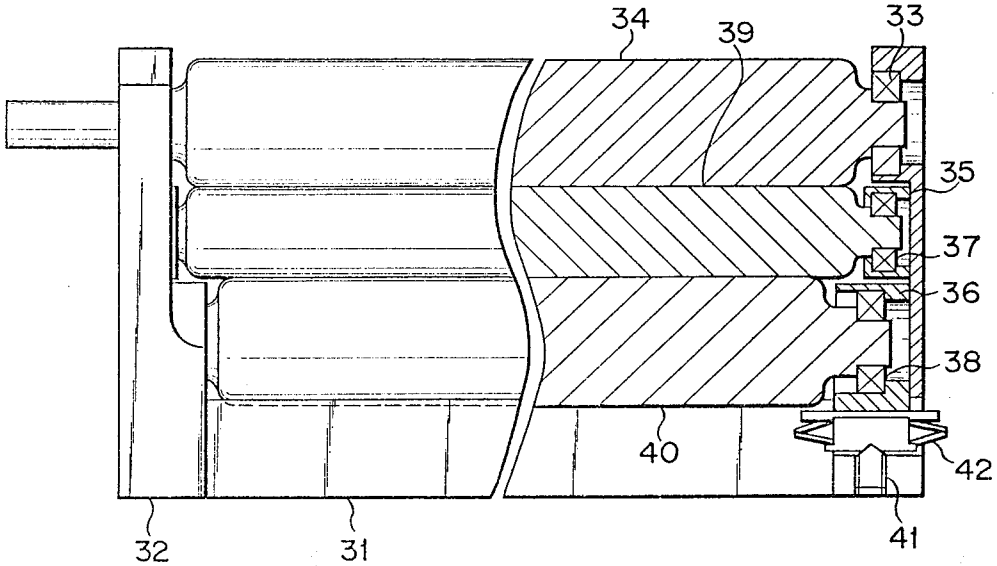
FIG. 3 (PRIOR ART)
Figure 6:
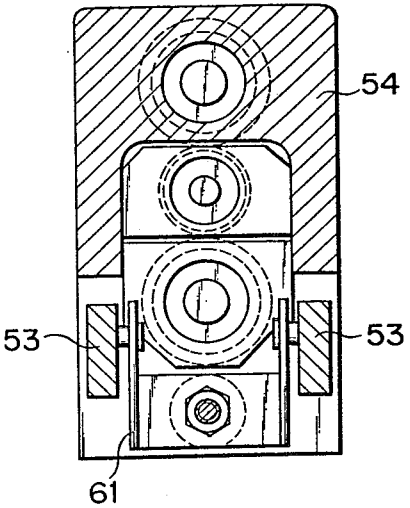
Figure 5:
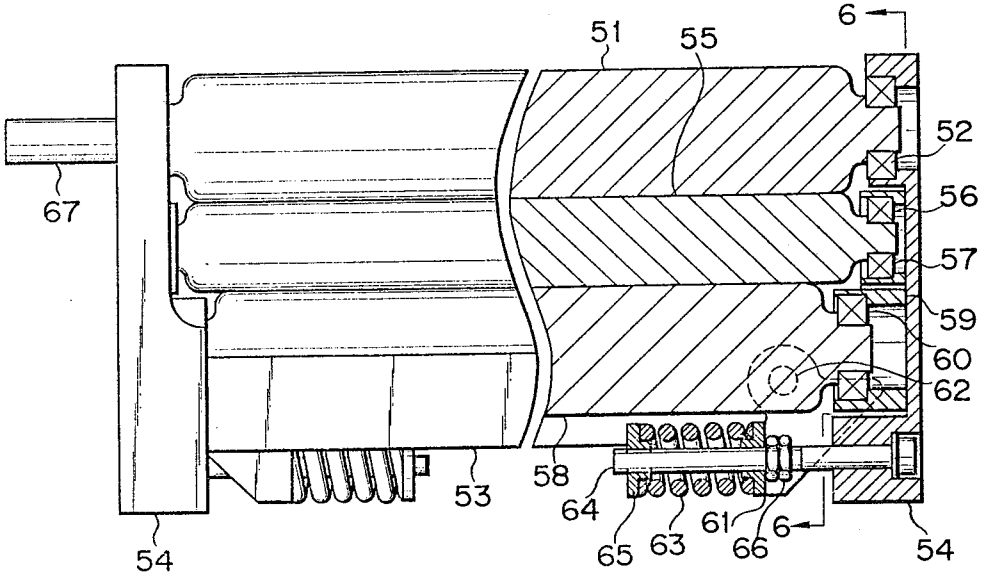

As shown in FIGS. 5 and 6, a pair of prism members or rods 53 are arranged between a pair of frames 54 spaced and facing each other so that the ends of the prisms 53 are coupled to their corresponding frames 54. The prisms 53 are spaced and extended parallel to each other near both sides of the lower portions of the frames 54. Bearings 52 are fixed individually to the upper portions of the opposite inner surfaces of the frames 54. Both end portions of an upper roll 51 are supported individually by the bearings 52 so that the upper roll 51 is rotatably attached to the frames 54. From the upper roll 51 protrudes a driving shaft 67 which is connected to a drive source (not shown) to be rotated thereby. A vertically extending groove section is formed in the middle portion of the inner surface of each frame 54, and a guide member 56 is vertically and slidably fitted in the groove section. The guide member 56 is fitted with a bearing 57 movable therewith. An intermediate roll 55 is supported by the bearings 57 so that it can rotate and move vertically relative to the frames 54. Another guide member 59 is located under the guide member 56 in the groove section of each frame 54. The guide member 59 is fitted with a bearing 60 movable therewith. A lower roll 58 is supported by the bearings 60 so that it can rotate and move vertically relative to the frames 54. In order to apply uniform pressure to a recording sheet to be fixed across its width, the rolls are so arranged that the axes of each two adjacent rolls are not parallel, nor in alignment, but somewhat cross each other, when viewed vertically.

Figure 7:
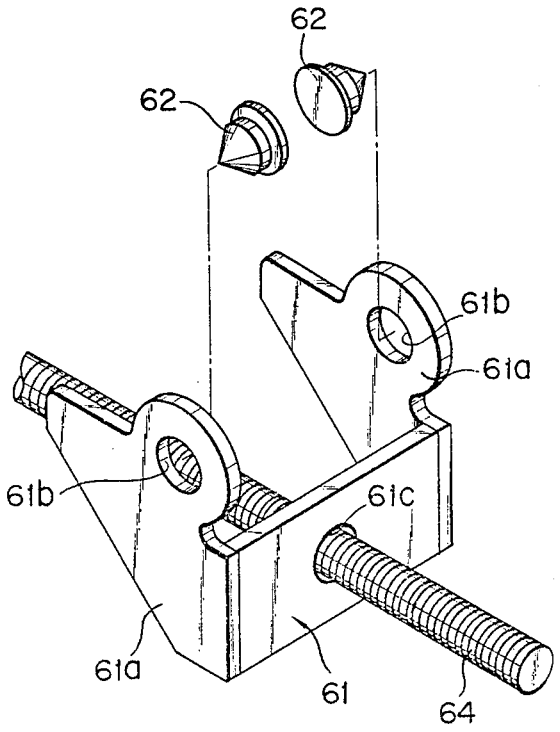
FIG. 7 is a perspective view of a pressure lever.

In FIGS. 5 and 6, numeral 61 designates a pressure lever disposed close to each frame 54. As shown in FIG. 7, the pressure lever 61 is formed by bending a plate in a U-shape. Through holes 61*b* are formed individually in both bent portions 61*a* of the lever 61, and pins 62 protruding from the respective inner surfaces of the prism members 53 are loosely fitted in the holes 61*b*, individually. Thus, the pressure levers 61 are supported between the prism members 53 so as to be rockable around their corresponding pins 62. A through hole 61*c* is formed in the central portion or rocking end portion of each pressure lever 61. The middle portion of a pressure bolt 64 is passed through the hole 61*c*. The bolt 64 is inserted into each corresponding frame 54 from the back side of the center of its lower portion so that the tip portion of the bolt 64 protrudes from the inner surface of the frame 54 and extends horizontally along the prism members 53. A nut member 66 is screwed on that portion of the bolt 64 which lies between the frame 54 and the lever 61 and abuts on the lever 61 to prevent the lever to move in a direction of the frame. Also, a pressure plate 65 is screwed on the tip end portion of the bolt 64. A horizontally extending compression coil spring 63 is interposed between the pressure plate 65 and the pressure lever 61 so as to surround the bolt 64 and so that both ends of the spring 63 abut against the members 65 and 61, individually. Both side end faces of the pressure plate 65 abut individually against the inner surfaces of the prism members 53. Thus, the pressure plate 65 is prevented from rotating by the prism members 53, and is moved along the axis of the bolt 64 as the bolt 64 is rotated. The pressure lever 61 is urged to rock in the counterclockwise direction of FIG. 5 by the urging force of the compression coil spring 63 one end of which is stopped by the pressure plate 65. Accordingly, the upper end of the lever 61 abuts against the lower end of its corresponding guide member 59 to press it upward. Thus, the lower roll 58 is shifted upward to press the intermediate roll 55 upward. As a result, the intermediate roll 55 is urged upward to be pressed against the upper roll 51 under a pressure or pushing force corresponding to the urging force of the spring 63. The urging force of the spring 63 can be adjusted by rotating the bolt 64 to move the pressure plate 65 along the axis of the bolt 64. The nut member 66 functions as a position regulating means capable of engaging the pressure lever 61 lest the lever 61, which is pressed toward its corresponding frame 54 by the spring 63, should move excessively toward the frame 54.

In the pressure fixing device of the aforementioned construction, the pushing force of the compression coil spring 63 extending substantially parallel to the rolls 51, 55 and 58 to act in the extending direction is changed in its direction at substantially right angles by the pressure lever 61. Then, a predetermined pressure is produced between the upper and intermediate rolls 51 and 55 through the medium of the lower roll 58. While rotating the upper roll 51 by means of the driving shaft 67, a recording sheet bearing thereon a toner image to be fixed is passed between the upper and intermediate rolls 51 and 55 for fixing.

In the pressure fixing device described above, compression coil springs with a spring constant considerably smaller than that of Belleville springs are used for the pressure producing means, so that the pressure between the rolls can be easily and accurately set. The pressure setting can be performed through the flank of the fixing device since the compression coil springs extend in substantially the same direction as the rolls. Thus, the pressure setting can be achieved with ease even though the fixing device is incorporated in a facsimile system or copying apparatus. Since the counterclockwise rocking of the pressure levers is restrained by the nut members screwed on the pressure bolts, the no-load contact pressure between the rolls can be lightened, or the rolls cain be separated a little from one another by adjusting the nut members. It is therefore possible to effectively produce the pressure between the rolls only when the recording sheet is passed between the rolls for fixing. Accordingly, if the fixing device is used in a facsimile or the like which is subject to prolonged no-load operation, the rolls are released from unnecessary mutual contact under high pressure. Thus, the functional lifetime of the rolls and bearings is much improved, and the fixing device can enjoy high reliability, requiring no maintenance or inspection for a long time. By adjusting the rolls so that a narrow gap is defined between them, the insertion of the recording sheet between the rolls is facilitated, and clashing of the rolls, which has conventionally been caused as a matter of course upon the separation of the recording sheet from the rolls, is eliminated. Thus, the rolls can be prevented from suffering deformation or from producing a noise. Since the compression coil springs extend in the same direction as the rolls, as described above, the fixing device can enjoy compact design without involving projection of the compression coil springs.

Figure 8:
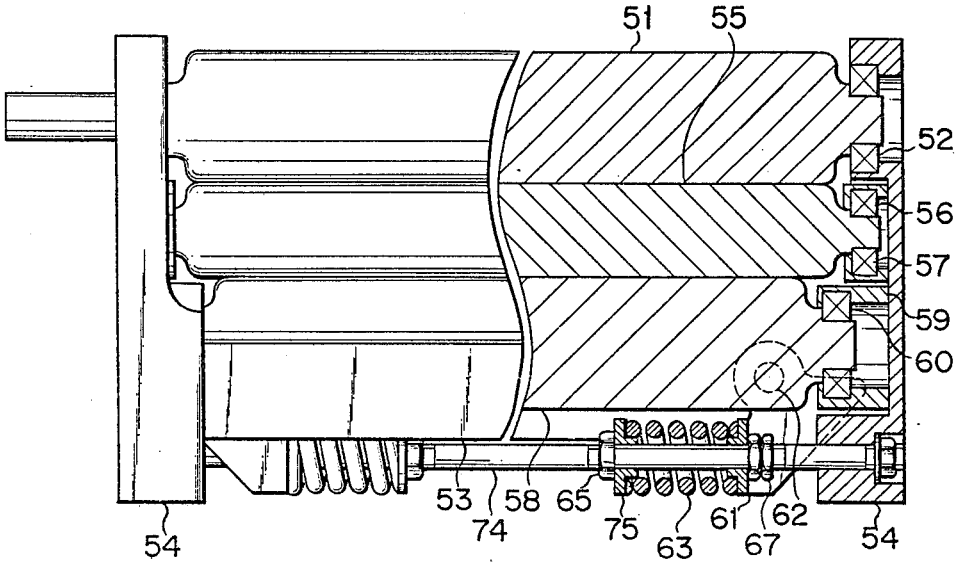
FIGS. 8 and 9 are front views of pressure fixing devices according to different embodiments of the invention.
Figure 9:
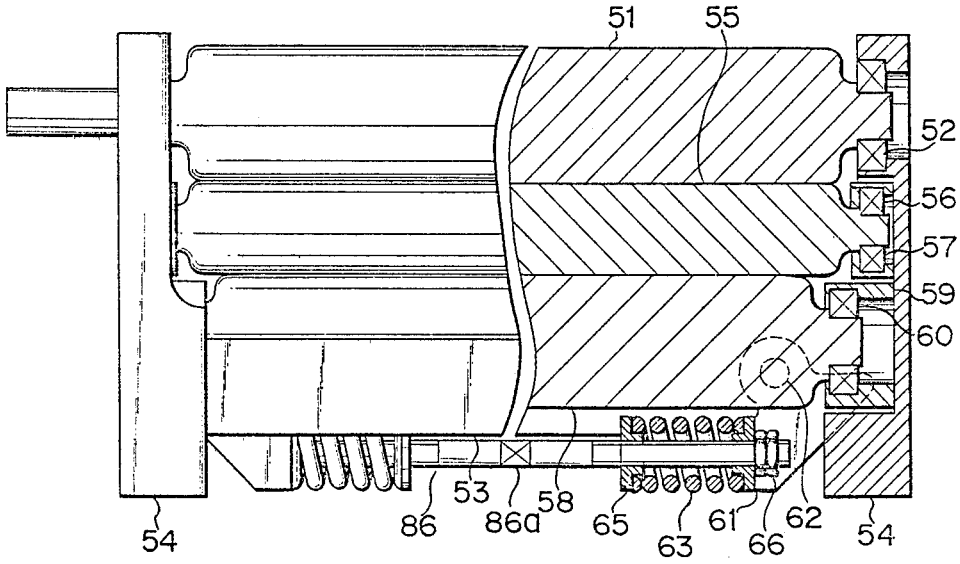

Referring now to FIGS. 8 and 9, there will be described pressure fixing devices according to alternative embodiments of the invention. In these embodiments, like reference numerals refer to the same portions as included in the foregoing embodiment.

In FIG. 8, numeral 74 designates a common pressure bolt which is used in place of the pair of pressure bolts 64. Both ends of the common pressure bolt 74 are fixed individually to the frames 54. Screwed on the pressure bolt 74 are pressure plates 65 for causing a pair of compression coil springs 63 to urge their corresponding pressure levers 61. Interposed between each pressure plate 65 and its corresponding coil spring 63 is a shifting plate 75 which has a hole in which the bolt 74 is loosely fitted. Thus, the urging force of the coil springs 63 can be adjusted with the aid of the shifting plates 75 by rotating the pressure plates 65 to move them along the bolt 74.

The pressure fixing device of the construction shown in FIG. 8 produces substantially the same effect as the embodiment shown in FIGS. 5 and 7.

The pressure fixing device according to the embodiment shown in FIG. 9 includes a common pressure bolt 86 which has screw sections formed of opposite thread grooves at both end sides, individually. Each screw section is fitted with a pressure plate 65, a compression coil spring 63, a pressure lever 61, and a nut member 66. The two end portions of the common pressure bolt 86 are not coupled to the frames 54, and are supported only by the pressure levers 61. An operating section 86*a* with a rectangular cross section is formed at the central portion of the bolt 86. The common pressure bolt 86 can be easily rotated with a suitable tool (not shown) held against the operating section 86*a*. As the bolt 86 rotates, the two pressure plates 65 move oppositely along the bolt 86. Thus, the two compression coil springs 63 are adjusted at the same time. At this adjustment, the common pressure bolt 86 is supported only by the pressure levers 61, and is allowed to move axially. Accordingly, even if the spring constants of the two compression coil springs 63 are not exactly in agreement, the pressure plates 65 receive equal spring pressures from the coil springs 63.

In the device according to the embodiment shown in FIG. 9, as described above, both compression coil springs can simultaneously be adjusted by rotating a common pressure bolt.

Although three rolls are used in the foregoing embodiments, only two rolls will suffice. The pressure mechanism may be located at the upper portion of the device so that the upper roll is moved vertically.

What is claimed is:

1. A pressure fixing device for a recording medium comprising:

a pair of frames spaced and facing each other;

a first roll located between the frames so that both ends of the first roll are supported individually by the frames for rotation;

a pair of guide members attached individually to the frames to be movable at right angles to the axis of the first roll;

a second roll disposed along the first roll so that both ends of the second roll are supported individually by the guide members for rotation, the recording medium being passed between the first and second rolls; and a mechanism for urging the second roll toward the first roll, the mechanism including a pair of compression coil springs extending along the axes of the rolls to apply an urging force in its extending direction, a pair of pressure levers rockable around an axis normal to the axes of the rolls and the moving direction of the guide members, the pressure levers receiving the urging force of the coil springs to urge the second roll toward the first roll, and adjusting means for adjusting the urging force of the compression coil springs.

2. The pressure fixing device according to claim 1, which further comprises another pair of guide members attached individually to the frames to be movable in the same direction as said guide members, and a third roll disposed along said rolls so that both ends of the third roll are supported individually by said another pair of guide members for rotation, and wherein said pressure levers abut against said another pair of guide members to urge the same in one direction, and the third roll abuts against the second roll to urge the same toward the first roll.

3. The pressure fixing device according to claim 1 or 2, wherein said adjusting means includes a pair of pressure bolts supported individually by the frames for rotation and extending along the axes of the rolls to approach each other, said compression coil springs supported by the pressure bolts inserted therethrough, a pair of pressure plates screwed on the ends of their corresponding pressure bolts and supporting one end of their corresponding compression coil springs, and members for preventing the pressure plates from rotating, and each said pressure lever having a rocking end portion with a hole in which each corresponding bolt is loosely fitted, the other end of each corresponding compression coil spring abutting against the rocking end portion.

4. The pressure fixing device according to claim 3, wherein said members for preventing the pressure plates from rotating are coupled to the frames at both ends and abut against the pressure plates.

5. The pressure fixing device according to claim 1 or 2, wherein said adjusting means includes a common pressure bolt fixed to the frames at both ends and extending along the axes of the rolls, said compression coil springs supported by two end portions of the common pressure bolt passed individually therethrough, and a pair of pressure plates screwed on the common pressure bolt and supporting one ends of their corresponding compression coil springs, and each said pressure lever having a rocking end portion with a hole in which the common pressure bolt is loosely fitted, the other end of each corresponding compression coil spring abutting against the rocking end portion.

6. The pressure fixing device according to claim 1 or 2, wherein said adjusting means includes a common pressure bolt extending along the axes of the rolls and having oppositely threaded sections at both end portions, said compression coil springs supported by the end portions of the common pressure bolt passed individually therethrough, a pair of pressure plates screwed on the threaded sections of the pressure bolt and supporting one ends of their corresponding compression coil springs, and members for preventing the pressure plates from rotating, and each said pressure lever having a rocking end portion with a hole in which the common pressure bolt is loosely fitted, the rocking end portion supporting the pressure bolt, and the other end of each corresponding compression coil spring abutting against the rocking end portion.

7. The pressure fixing device according to claim 6, wherein said members for preventing the pressure plates from rotating are coupled to the frames at both ends and abut against the pressure plates.

8. The pressure fixing device according to claim 1 or 2, which further including means for preventing the pressure lever to move along the axis of the roll by the force of the compression coil spring.

* * * * *